US005391059A

United States Patent [19]

Hallundbaek

[11] Patent Number: 5,391,059

[45] Date of Patent: Feb. 21, 1995

[54] RADIAL PISTON MOTOR OR PUMP

[75] Inventor: Jørgen Hallundbæk, Lyngby, Denmark

[73] Assignee: H T C A/S, Glostrup, Denmark

[21] Appl. No.: 74,815

[22] PCT Filed: Dec. 9, 1991

[86] PCT No.: PCT/DK91/00385

§ 371 Date: Jun. 8, 1993

§ 102(e) Date: Jun. 8, 1993

[87] PCT Pub. No.: WO92/10676

PCT Pub. Date: Jun. 25, 1992

[30] Foreign Application Priority Data

Dec. 10, 1990 [DK] Denmark ..... 2926/92

[51] Int. Cl.[6] ..... F04B 1/04

[52] U.S. Cl. ..... 417/27.3; 91/498; 92/58; 92/72

[58] Field of Search ..... 417/273; 91/491, 498; 92/12.1, 58, 72, 148

[56] References Cited

U.S. PATENT DOCUMENTS

| | | | |
|---|---|---|---|
| 1,509,169 | 9/1924 | McFarland | 417/273 |
| 2,872,875 | 2/1959 | Mergen et al. . | |
| 3,010,405 | 11/1961 | Tomell . | |
| 3,078,808 | 2/1963 | Byers, Jr. . | |
| 3,392,634 | 7/1968 | Tobias . | |
| 3,585,904 | 6/1971 | White | 91/498 |
| 3,810,418 | 5/1974 | Bosch | 91/498 |
| 4,033,239 | 7/1977 | Gsching | 92/148 |
| 4,132,154 | 1/1979 | Nishiba . | |
| 4,700,613 | 10/1987 | Tiljander . | |
| 4,704,948 | 11/1987 | Wusthof et al. . | |
| 5,018,433 | 5/1991 | Bigo . | |
| 5,179,889 | 1/1993 | Wusthof et al. | 91/491 |

FOREIGN PATENT DOCUMENTS

| | | | |
|---|---|---|---|
| 2537552 | 3/1977 | Germany . | |
| 2254545 | 2/1979 | Germany . | |
| 3220492 | 11/1984 | Germany . | |
| 0099074 | 6/1984 | Japan | 417/273 |
| 0204978 | 10/1985 | Japan | 417/273 |
| 488107 | 5/1970 | Switzerland . | |
| 2243881A | 11/1991 | United Kingdom . | |

*Primary Examiner*—Richard A. Bertsch
*Assistant Examiner*—M. Kocharov
*Attorney, Agent, or Firm*—Merchant & Gould Smith, Edell, Welter & Schmidt

[57] ABSTRACT

A motor or pump assembly (1) comprises a cylinder block (4) with a plurality of radially positioned cylinders (3), a piston (2) arranged slidably reciprocable in each of the cylinders, a cam ring (7) cooperating with the pistons and being rotatably journalled on the cylinder block, and a distributor valve (9) arranged centrally in the cylinder block to control a flow of fluid to and from the cylinders in operation. The cam ring (7) is journalled on the cylinder block (4) with at least one ball bearing with balls (25) arranged on each side of the cylinder block. These balls run in grooves which are positioned close to the sides and periphery of the disc-shaped cylinder block. This provides a structure which has a very small axial length and which is simultaneously capable of absorbing great loads both radially and laterally.

2 Claims, 4 Drawing Sheets

RADIAL PISTON MOTOR OR PUMP

Figure 1:
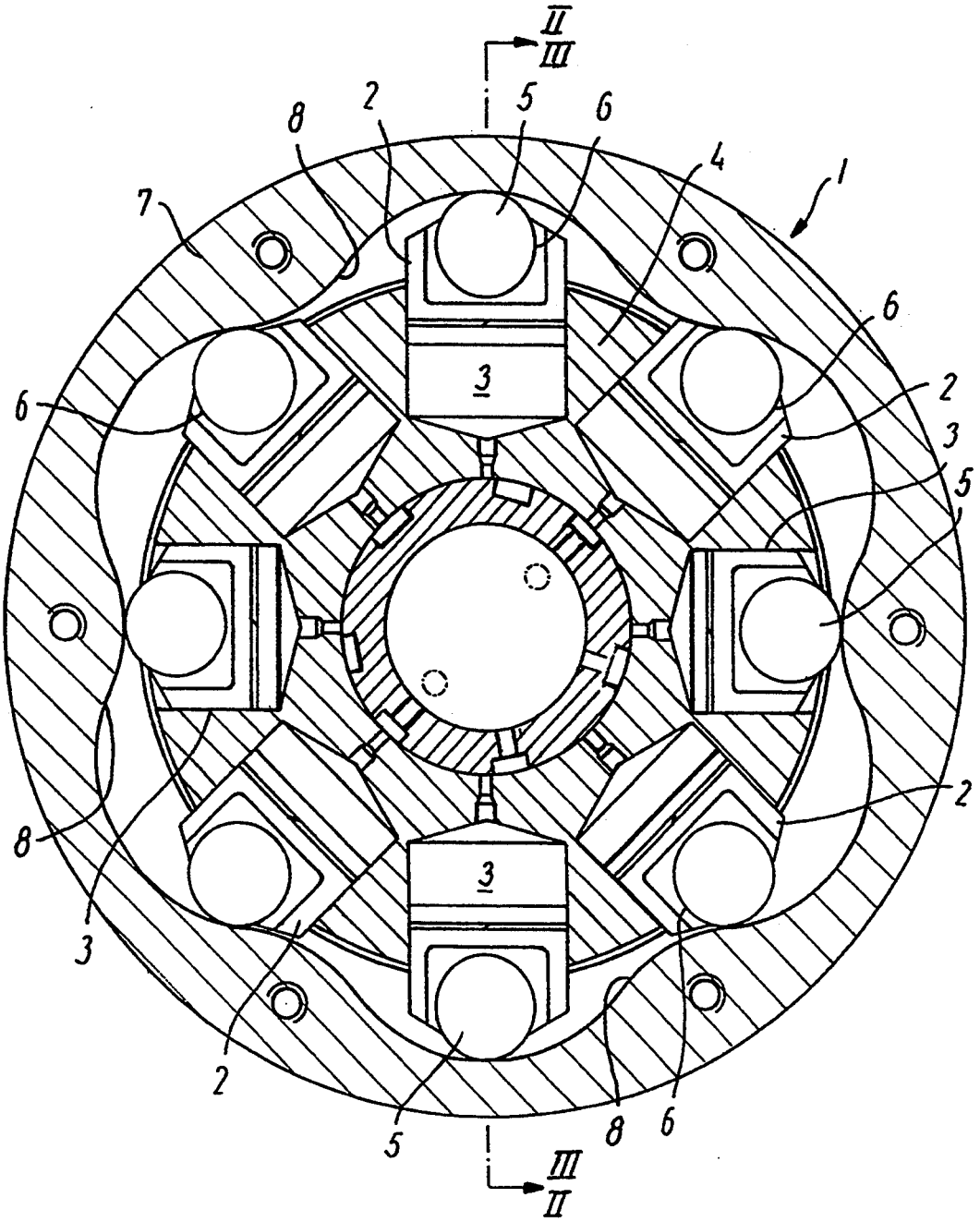

The invention concerns a motor or pump assembly comprising a cylinder block with a plurality of radially positioned cylinders, a piston arranged slidably reciprocable in each of the cylinders, a cam ring cooperating with the pistons and being rotatably journalled on the cylinder block, and a distributor valve arranged centrally in the cylinder block to control the flow of fluid to and from the cylinders in operation.

Assemblies of this type operate in the manner that during mutual rotation between the cam ring and the cylinder block the pistons travel to and fro in their cylinders in step with a boss or roller on the piston top running up and down a plurality of wave-shaped cams on the inner side of the cam ring. This special pattern of motion entails that the assembly cannot or has difficulty in operating at greater relative speeds of rotation, and that it must be constructed with corresponding large dimensions to be able to provide the desired power. It therefore frequently presents considerable difficulties to incorporate conventional assemblies of this type in machinery with restricted space, as is e.g. the case in the apparatus described in the applicant's International Patent Application PCT/DK89/00213 for drilling underground bore holes. Owing to the large output moment of the assembly at low speeds of rotation it would otherwise, i.e. apart from its great space requirement, be extremely suitable for direct incorporation as a drive motor in the wheels of the drilling apparatus, as well as in other cases where the special properties of the assembly can be utilized to advantage.

The object of the invention is to provide an assembly of the type stated in the opening paragraph, which, with a stable and reliable structure, has a smaller axial length with respect to the capacity than known before, and is simultaneously simple and inexpensive to manufacture and easy to dismantle and assemble again in connection with service and repair.

The assembly of the invention is novel and unique in the cylinder block and the cam ring are provided with approximately the same width and the cam ring and the distributor valve are connected with a thin carrier plate which just clears the cylinder block. This entails that the entire assembly per se will have the shape of a relatively narrow disc, which is excellently suitable for incorporation as a drive motor in a wheel for e.g. the drilling equipment described in the applicant's above-mentioned PCT application.

The relative direction of rotation between the cylinder block and the cam ring is determined by the angular position of the distributor valve with respect to the cams. It will be desirable in many cases that this direction of rotation can be changed, and this is obtained according to the invention by equipping the structure with two detachable connections between the cam ring and the distributor valve and positioning these connections in positions that correspond to their respective relative directions of rotation.

Figure 2:
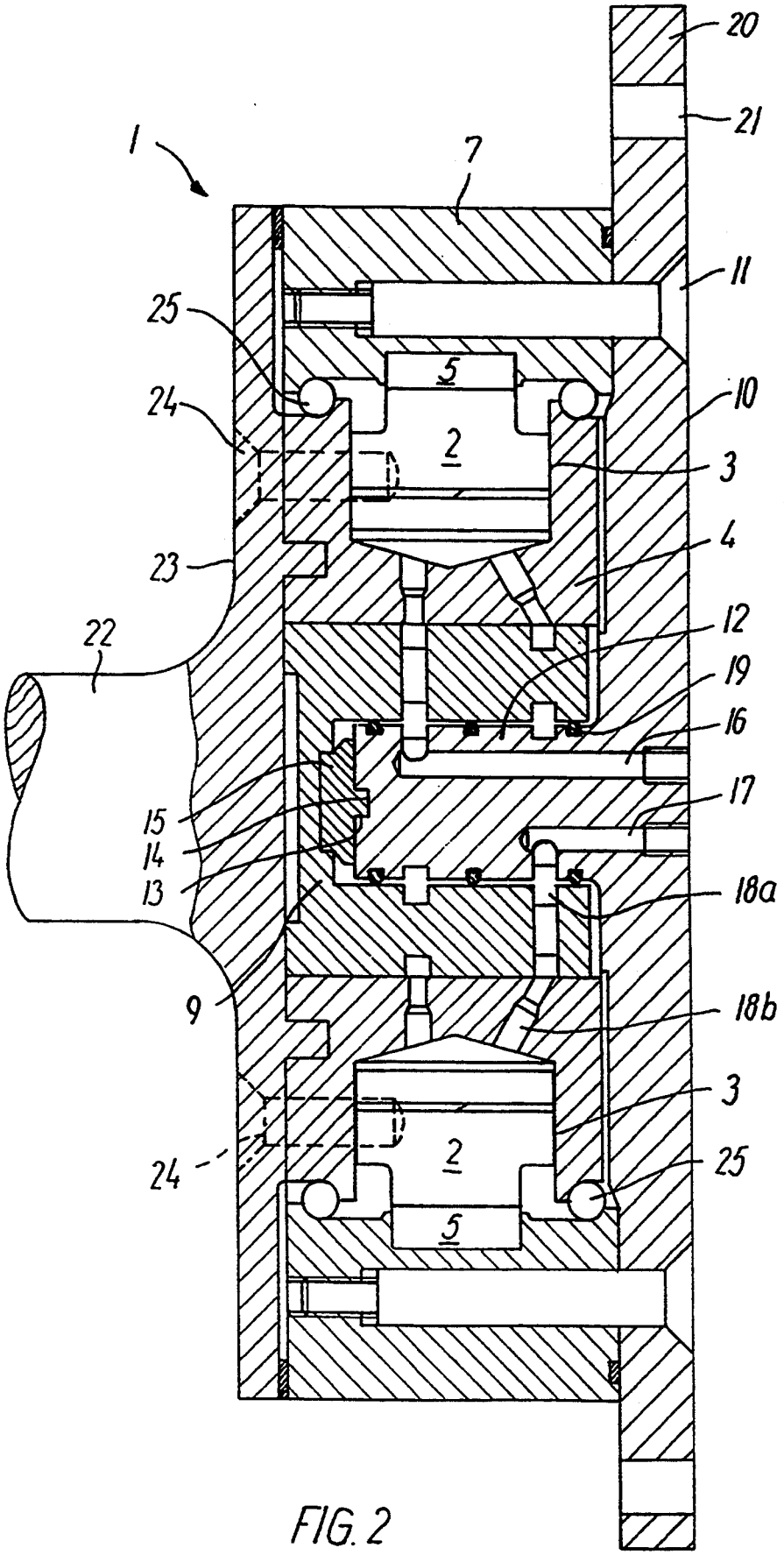
Figure 3:
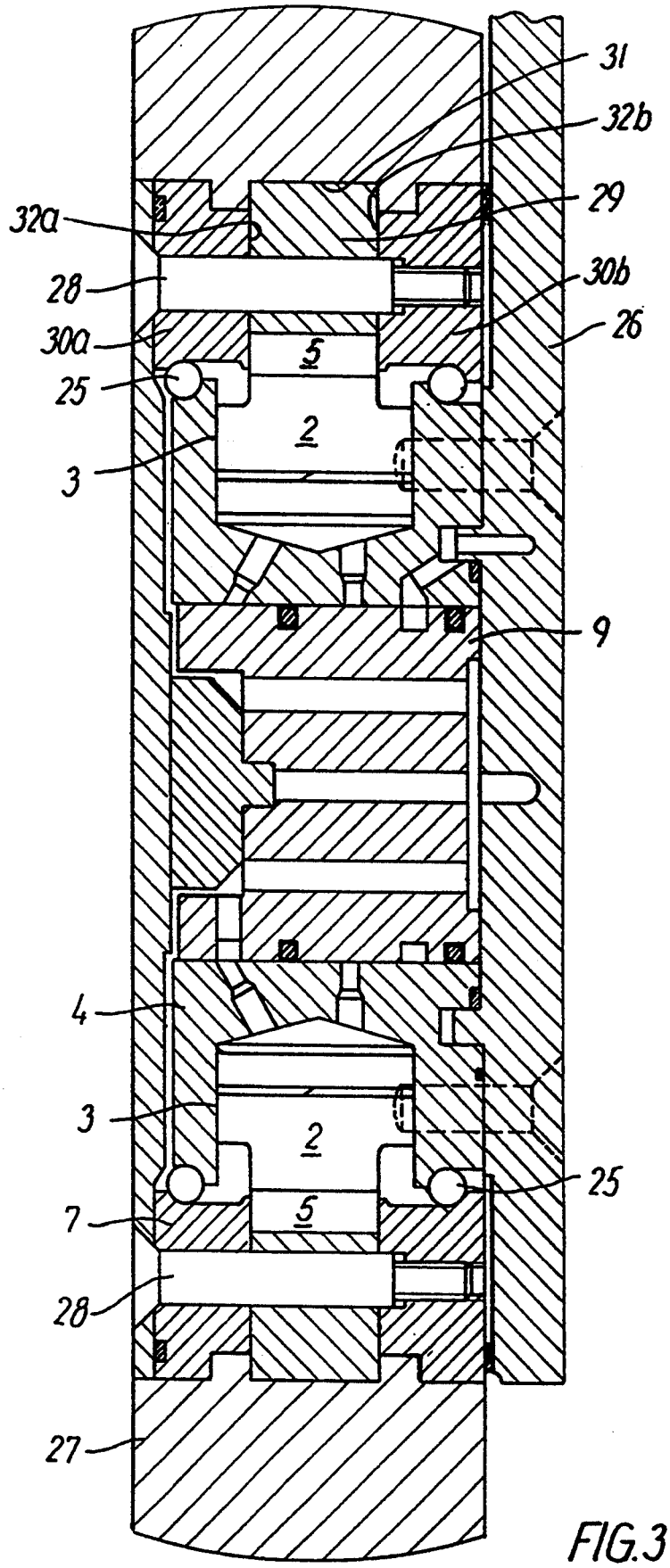
Figure 4:
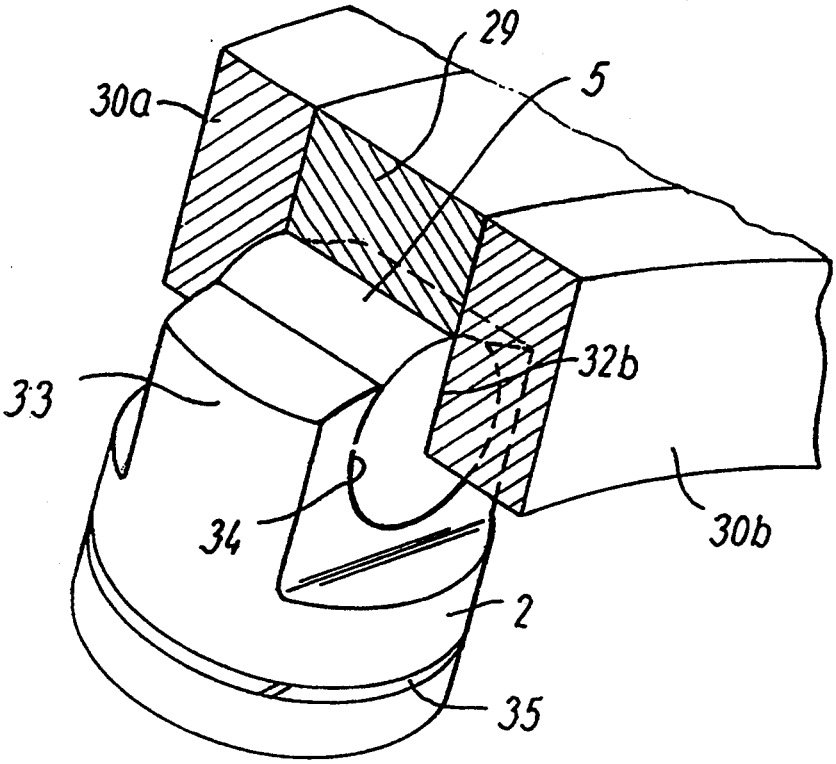
Figure 5:
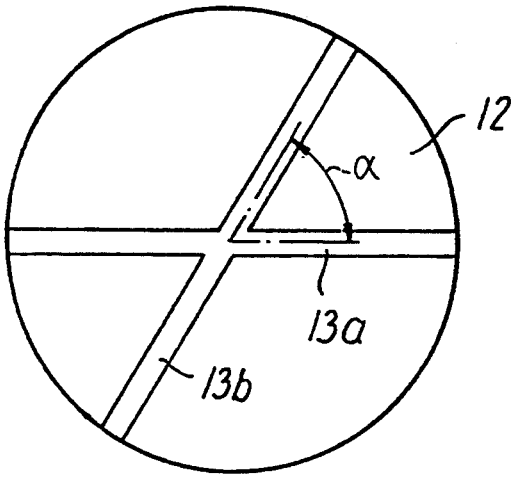

The invention will be explained more fully by the following description of embodiments, which just serve as examples, with reference to the drawing, in which FIG. 1 is a radial section through an assembly according to the invention, FIG. 2 shows a first embodiment of an assembly according to the invention, seen along the line II—II in FIG. 1, FIG. 3 shows a second embodiment of an assembly according to the invention, seen along the line III—III in FIG. 1, FIG. 4 is a perspective view of a fragment of a tripartite cam ring associated with the assembly and a piston with a roller running in a groove in the cam ring, and FIG. 5 is an enlarged end view of a carrier pin with two mutually angularly displaced slots for reversing the relative direction of rotation.

In principle, the assembly of the invention can work with any fluid and serve as either a motor or a pump in response to the circuit of the fluid. The invention is described below on the assumption that the assembly is a motor working with hydraulic oil fed from a source of pressure, e.g. a hydraulic pump.

In FIG. 1, the hydraulic motor, which is generally indicated by 1, is shown in radial section. In this case the motor has eight pistons 2 capable of travelling to and fro in cylinders 3, which are provided in a cylinder block 4 and extend radially outwardly in it at equidistant angular distances. Each piston rotatably mounts a roller 5 in a slide bearing 6 provided at the top of the piston 2. A cam ring 7 having six wave-shaped cams 8 on the inner side is arranged around this arrangement, and, as shown, the 10 rollers 5 rest against these cams in any of the positions of the pistons.

As shown in FIG. 2, a drum-shaped distributor valve 9 is arranged centrally in the cylinder block 4, said distributor valve being firmly connected with the cam ring 7 by means of a carrier plate 10, which is screwed firmly on to the cam ring 7 by screws 11 and engages, by means of a carrier pin 12 with a slot 13, a tongue 14 on a coupling member 15 secured to the distributor valve 9. The carrier plate 10 extends at a small distance past the cylinder block 4, which can therefore rotate freely with respect to the cam ring 7. The carrier plate 10 has a feed channel 16 for the hydraulic oil which is fed under pressure from a pump having an oil reservoir, which receives the return oil from an outlet channel 17 in the carrier plate. These channels 16, 17 are connected in the carrier pin 12 with a first set of distributor channels 18a which, via a second set of distributor channels 18b in the bottom of the cylinders 3, control the flow of-oil out of and into these. Three O-rings provide a safeguard against overflow between the individual channels and out to the other parts of the motor. The arrangement and mode of operation of the distributor valve per se are of a conventional type and will therefore not be described more fully here.

The carrier plate 10 continues into a flange 20 with fixing holes 21 for attaching the motor on the site of use. In this case, the cam ring 7 is thus stationary, while the cylinder block rotates when the motor works. The torque is made available via a shaft 22 which with a shaft plate 23 is screwed firmly onto the cylinder block 4 by means of screws 24. Of course, the arrangement might be the reverse, so that it was the cylinder block that was stationary, while the cam ring rotated, the output shaft being provided on the carrier plate.

As shown in FIGS. 2 and 3, the cylinder block 4 is constructed as a disc which is only so much wider than the pistons 2 as is necessary for reasons of strength. The cam ring 7 is provided with approximately the same width as the cylinder block 4 and is journalled on it with balls 25 running in grooves, which are provided in an area close to the sides and periphery of the disc-shaped cylinder block on the cam ring and the cylinder block, respectively, which will thereby form the inner and outer race in a bearing.

By means of the above-mentioned arrangement the bearing, which is constructed as an angular contact bearing in the shown embodiment, will be capable of absorbing much greater loads laterally as well as radially because of its large diameter than corresponding conventional structures. In addition to this advantage, the motor is given a very compact structure in the form of a relatively narrow disc having a relatively small diameter and axial extent.

FIG. 3 shows a second embodiment of a motor which is arranged as a wheel for the self-propelling drilling apparatus described in the applicant's previously mentioned patent application PCT/DK89/00213, which is incorporated in the present application as a reference. In this case, the cylinder block 4, which is swingably suspended from the drilling apparatus (not shown) with a wheel plate 26, is stationary, while the cam ring 7 is rotatable and serves to transfer the traction forces of the drilling apparatus to the wall of the bore hole via a bandage 27 of an elastic material, e.g. rubber.

In the shown embodiment the cam ring 7 is divided into three rings which are clamped together with screws 28. The three rings consist of a central ring 29 and two lateral rings 30*a*, 30*b*. These three rings together define a groove whose bottom contains the cams 8 of the cam ring 7, and whose sides 32*a*, 32*b* serve to guide the rollers 5 in their axial direction in a manner which will be explained more fully below. A corresponding groove is provided in the embodiment shown in FIG. 2, where, however, the cam ring is not correspondingly divided into three rings. This division provides the advantage that it is cheaper to manufacture the cam ring with the groove, and that the motor can be disassembled and assembled again more easily for service and replacement of worn parts. Otherwise, the general arrangement of the wheel essentially corresponds to that of the previously described embodiment, to which reference is therefore made in this connection.

As shown in FIG. 4, the roller 5 is constructed with a smaller axial length than the width of the piston 2 for practical reasons; the piston 2 is moreover so machined in an area at the roller as to leave a central member 33 which has the same width as the roller, and in which a slide bearing 34 is provided to support the roller. During mounting, the roller is pushed inwardly from the end of the bearing, the roller being supported radially, but not axially. However, axial support is provided in the assembled state of the motor by the sides 32*a*, 32*b* of the previously mentioned groove, which have the same or a slightly different mutual distance than the axial length of the roller, the sides 32*a*, 32*b* also having a diameter at the mouth of the groove which is smaller than the cylinder face enveloping the rollers in the bottom position of the pistons, so that the rollers cannot leave the groove at any point of it.

The cams 8 are positioned in the bottom 31 of the groove, which limits outward travel of the pistons at the deepest point between the cams, while the bottom of the cylinders limits the travel inwardly. Since the central member 33 has the same width as the axial extent of the roller, this part of the piston can follow the roller into the groove. The piston travel and the depth of the groove will hereby partially overlap each other and reduce the outside diameter of the motor by a size corresponding to twice this overlap. This arrangement and the previously described bearing structure provide the advantage that the motor of the invention can be constructed with a much smaller diameter than conventional motors of this type with the same performance. FIG. 4 also shows a piston ring 35 to seal the pistons 2 with respect to the cylinders 3 during operation.

FIG. 5 is an end view of an embodiment of a piston pin 12 with two slots 13*a*, 13*b* forming such an angle a with each other that, when engaged with the tongue 14 of the coupling part 15 (FIG. 2), they position the distributor valve 9 in positions which correspond to their respective oppositely directed relative directions of rotation, which can be reversed simply and easily, if desired. The angle $\alpha$ is a function of the cam number n and can be expressed by $$\alpha = \tfrac{1}{2} \times \frac{360^\circ}{n} + m \times \frac{360^\circ}{n}$$

m being a whole multiple of the angle between two cams. In the shown example with six cams:

$$\alpha = 30^\circ + m \times 60^\circ.$$

The assembly of the invention is described above in its function as a hydraulic motor and with exemplary ways of attaching the stationary part, i.e. either the cylinder block or the cam ring, and making the torque available from the rotating part. However, the said connections of the two parts can take place in many other ways within the scope of the invention, which might be expedient for the purposes for which the motor is to be used in each individual case.

As mentioned before, with the same fundamental structure as the motor the assembly can conversely serve as a hydraulic pump, either the cylinder block or the cam ring being then caused to rotate by means of an outer source of power, e.g. a motor. In this case too, the compact structure of the assembly is beneficial when the assembly is to be used in restricted space. The working range of the pump is substantially at relative low numbers of revolutions, and the pump is therefore extremely suitable for purposes where the pump is to be incorporated in machinery, e.g. agricultural machinery with slow-speed shafts for driving the pump, since the pump can then be used directly without any costly intermediate gear having to be inserted.

It should moreover be mentioned that both in its function as a motor and as a pump the assembly can work with any suitable fluid. Thus, hydraulic oil is mentioned by way of example in the foregoing, but also air may advantageously be chosen as working fluid for many purposes, so that the motor is driven by compressed air and the pump will be in the nature of a compressor that generates compressed air.

I claim:

1. A motor or pump assembly, comprising a cylinder block with a plurality of radially positioned cylinders;

a piston arranged slidably reciprocable in each of the cylinders;

a cam ring having a plurality wave-shaped cams on an inner side of the cam ring, the cam ring cooperating with the pistons and being rotatably journalled on the cylinder block;

a distributor valve arranged centrally in the cylinder block to control a flow of fluid to and from the cylinders in operation;

wherein the cam ring is journalled on the cylinder block with at least one bearing arranged on each side of the cylinder block, the cylinder block has a shape of a disc with the bearings at least partly positioned between planes containing sides of the disc and at a periphery of the disc, and the cylinder block and the cam ring constitute an inner and an outer surfaces, respectively, of said bearings; and wherein the cylinder block and the cam ring have substantially a same width, and the cam ring and the distributor valve are interconnected by means of a disc-shaped carrier plate extending past one side of the cylinder block at a distance from it.

2. An assembly according to claim 1, wherein the cam ring and the distributor valve are detachably interconnected in at least two mutually angularly displaced positions.

* * * * *